US005156542A

United States Patent [19]

Hannen et al.

[11] Patent Number: 5,156,542

[45] Date of Patent: Oct. 20, 1992

[54] HEAT GUN

[75] Inventors: Reiner Hannen, Goch-Pfalzdorf, Fed. Rep. of Germany; Robert Habegger, Cormoret, Switzerland

[73] Assignee: Develop, Reiner Hannen & Cie, Courtelary, Switzerland

[21] Appl. No.: 710,810

[22] Filed: Jun. 5, 1991

[30] Foreign Application Priority Data

Jun. 5, 1990 [DE] Fed. Rep. of Germany ... 9006308[U]

[51] Int. Cl.[5] ..... F23D 14/00

[52] U.S. Cl. ..... 431/158; 431/354; 431/353; 431/114

[58] Field of Search ..... 431/354, 158, 353, 114

[56] References Cited

U.S. PATENT DOCUMENTS

| | | | |
|---|---|---|---|
| 329,844 | 11/1885 | Mulloy | 431/354 |
| 569,984 | 10/1896 | Blanchard | 126/85 R |
| 2,117,270 | 5/1938 | Bloom | 431/354 |
| 2,239,025 | 4/1941 | Vigneault | 431/354 |
| 2,720,257 | 10/1955 | Lynes | 431/354 |
| 3,070,317 | 12/1962 | Hunter et al. | 431/353 |
| 3,940,234 | 2/1976 | Reed et al. | 431/114 |
| 4,029,462 | 6/1977 | Bitterlich | 431/114 |
| 4,128,389 | 12/1978 | Straitz | 431/114 |
| 4,886,446 | 12/1989 | Courrege | 431/354 |

FOREIGN PATENT DOCUMENTS

| | | | |
|---|---|---|---|
| 2030280 | 4/1980 | United Kingdom | 431/354 |

*Primary Examiner*—Carroll B. Dority

*Attorney, Agent, or Firm*—Herbert Dubno; Andrew Wilford

[57] ABSTRACT

A gas-fired heat gun has a housing, a nozzle in the housing for directing a stream of a combustible gas in a predetermined direction along an axis in the housing, and at least two mixing tubes including an upstream tube and a downstream tube in the housing coaxial with the nozzle and downstream therefrom. Each tube has a large-diameter upstream end and a small-diameter downstream end with the downstream end of the upstream tube spacedly received within the upstream end of the downstream tube so that air is entrained axially into both upstream ends by the combustible-gas stream. A combustion chamber is provided in the housing coaxial with and immediately downstream of the downstream end of the downstream tube.

6 Claims, 5 Drawing Sheets

HEAT GUN

FIELD OF THE INVENTION

The present invention relates to a heat gun. More particularly this invention concerns such a gun that incorporates a gas burner and that is used for shrink wrapping.

BACKGROUND OF THE INVENTION

A standard gas-fired heat gun of the type used for shrink wrapping comprises an elongated housing having an upstream end provided with a gas nozzle that projects a stream of combustible gas axially along the housing. A mixing tube concentric with the gas stream has a large-diameter upstream end spacedly surrounding the nozzle and and a small-diameter downstream end opening into a combustion chamber. Thus as in a jet pump the stream of gas sucks air into the upstream end of the tube and mixes with it. An igniter in the combustion chamber ignites the mixture. Such a heat gun can be used to shrink a foil wrapped around goods to package them.

In order to ensure adequate mixing of the oxygen-containing combustion-supporting air and the combustible gas. It is normally necessary to provide a relatively long mixing tube. As a result the gun has a relatively large overall length that makes using it fairly difficult.

OBJECTS OF THE INVENTION

It is therefore an object of the present invention to provide an improved heat gun.

Another object is the provision of such an improved heat gun which overcomes the above-given disadvantages, that is which is fairly compact yet which delivers a big stream of hot gas.

SUMMARY OF THE INVENTION

A gas-fired heat gun according to this invention has a housing, a nozzle in the housing for directing a stream of a combustible gas in a predetermined direction along an axis in the housing, and at least two mixing tubes including an upstream tube and a downstream tube in the housing coaxial with the nozzle and downstream therefrom. Each tube has a large-diameter upstream end and a small-diameter downstream end with the downstream end of the upstream tube spacedly received within the upstream end of the downstream tube so that air is entrained axially into both upstream ends by the combustible-gas stream. A combustion chamber is provided in the housing coaxial with and immediately downstream of the downstream end of the downstream tube.

With this system the mixing is excellent, but the use of multiple short mixing tubes, which are normally constructed as trumpet-shaped venturis, gives extremely good mixing in a relatively reduced space. Thus the gun can be fairly short but can still produce more hot gas than a prior-art long gun.

According to the invention the downstream end of the downstream tube is of greater diameter than the downstream end of the upstream tube. In addition the chamber has an upstream end that forms a smooth continuation of the downstream tube. The housing is formed with inlet ports admitting air to the upstream tube ends and it is provided at least around the inlet ports with sound insulation. The combustion chamber has an outer wall provided with insulation and covered with heat-resistant material.

The housing surrounds the chamber which itself is generally cylindrical and has a predetermined diameter D. The gun further has an output nozzle having an upstream end of the diameter D connected to the chamber and a downstream end of a diameter T smaller than the diameter D spaced axially downstream therefrom and a flame arrester in the chamber spaced upstream by a predetermined distance 1 from the upstream end of the output nozzle and a predetermined distance L from the downstream end of the output nozzle. The distances and diameters substantially conform to the relationship $$T/1=L/D.$$

The device is also provided with a turbulence-suppressing grill in the chamber, a flame arrester in the chamber downstream of the grill, and an electrical igniter in the chamber downstream of the arrester. The igniter includes a pair of electrodes in the chamber, one of these electrodes being formed by the conductor of a feed wire and the other by a grounded sleeve surrounding it and extending coaxial with the chamber.

Furthermore in order to stabilize the flame, according to this invention the downstream end of the upstream tube has a predetermined diameter and the burner is spaced upstream from the downstream end of the upstream tube by a distance equal to between 1.5 and 2.5 times the diameter. The burner is teardrop shaped.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
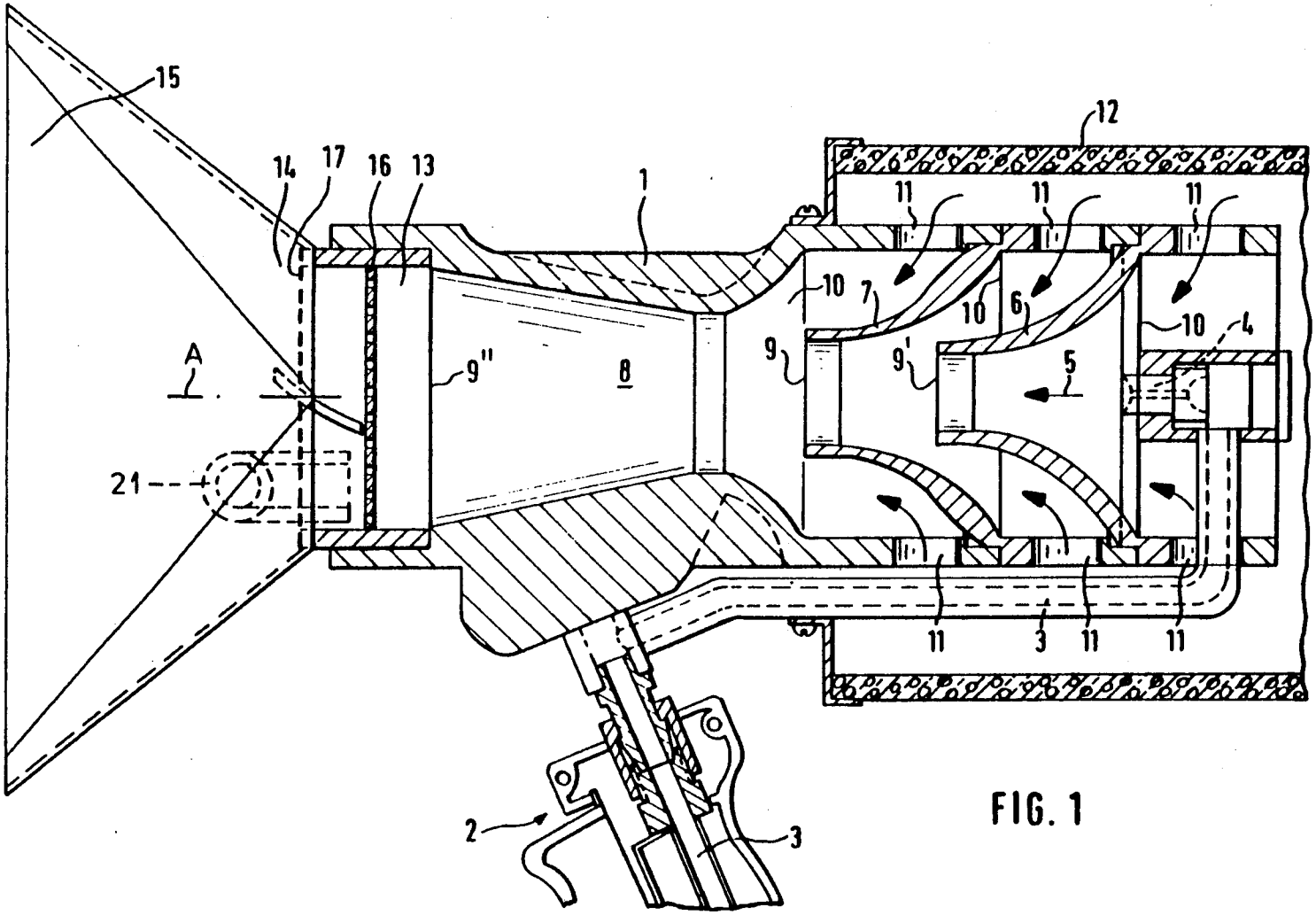
FIG. 1 is an axial section through a heat gun according to the invention.

As seen in FIG. 1 a heat gun according to this invention has a housing 1 with a handle 2 in which is accommodated a gas-feed conduit or pipe 3 leading to an injector nozzle 4 provided at an axis A at an upstream end of the housing 1 to project a gas stream axially in the housing 1 as shown by arrow 5. Immediately downstream of the nozzle 4 is a trumpet-shaped upstream mixing nozzle 6 and, immediately downstream therefrom, another such nozzle 7. The nozzles 6 and 7 have downstream ends 9 and 9' of increasing diameter and upstream ends 10 of the same diameter. The downstream tube 7 feeds into the upstream end 10 of a venturi tube 8 whose downstream end 9'' is even larger than the end 9'. Upstream of each upstream end 10 the housing 1 is formed with air inlets 11 and the housing 1 is surrounded around these inlets 11 with sound insulation 12.

The downstream end of the downstream tube 8 opens into a final cylindrical mixing chamber 13 separated by a turbulence-suppressing grill 16 from a combustion chamber 14 provided with a flame suppressor and with an igniter 21. The combustion chamber 14 opens into an output nozzle or horn 15 flaring axially in the downstream direction.

In the gun of FIGS. 2 through 5 reference numerals identical to those of FIG. 1 are used for functionally identical structure. Here two intermediate mixing tubes 7 are provided, one downstream of the other and the downstream one having a slightly larger downstream end 9'.

This arrangement has in the center of the flame-suppressor 17 the igniter 21 which is comprised of an igniter tube 22 that is open only in the axial downstream direction and that is substantially filled with a plug 23 of insulating material in which is imbedded an electrical wire 24 whose conductor end 25 projects from the downstream end of the plug 23. The tube 22 is grounded so that a spark or arc can easily be drawn between the conductor 25 and the tube 22 to ignite the gas mixture in the chamber 14. In addition in this arrangement the output nozzle 15 is tapered axially downstream, opposite to the flared system of FIG. 1, and has a ceramic wall 18 with a sheet metal outer cladding 19 and inner cladding 20.

Figure 2:
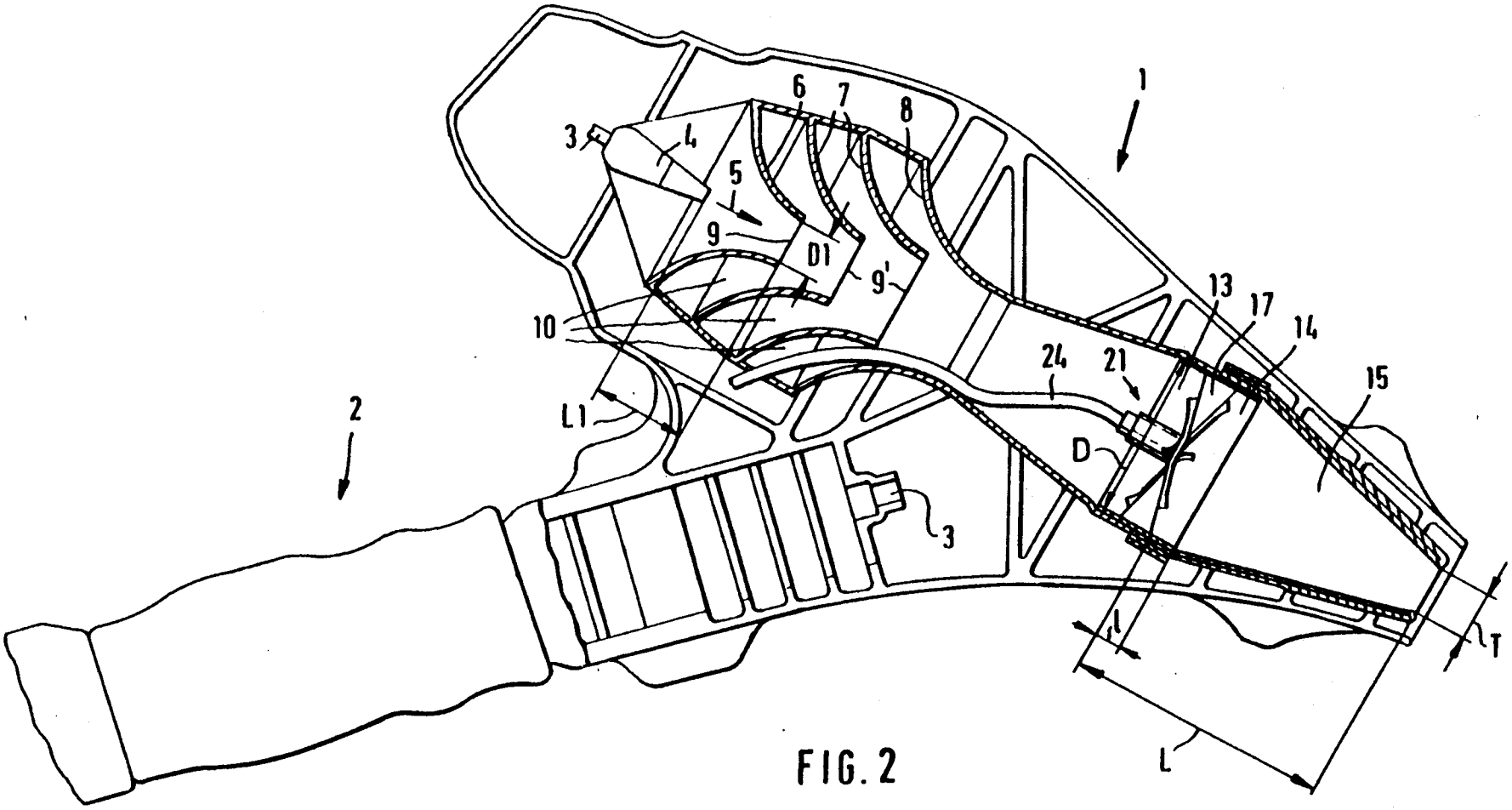
FIG. 2 is an axial section through another gun in accordance with this invention.
Figure 3:
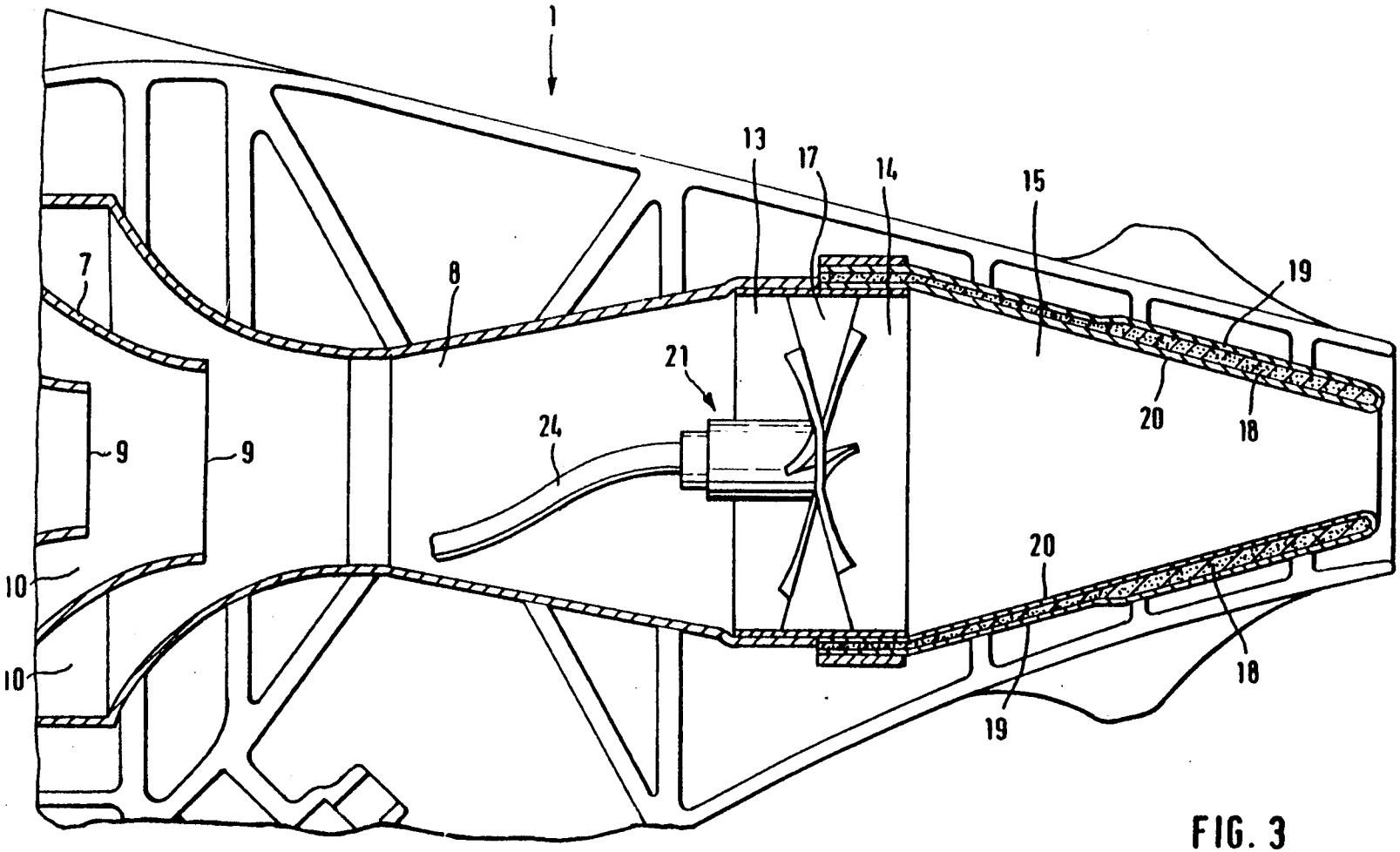
FIGS. 3, 4, and 5 are large-scale views of details of FIG. 2.
Figure 4:
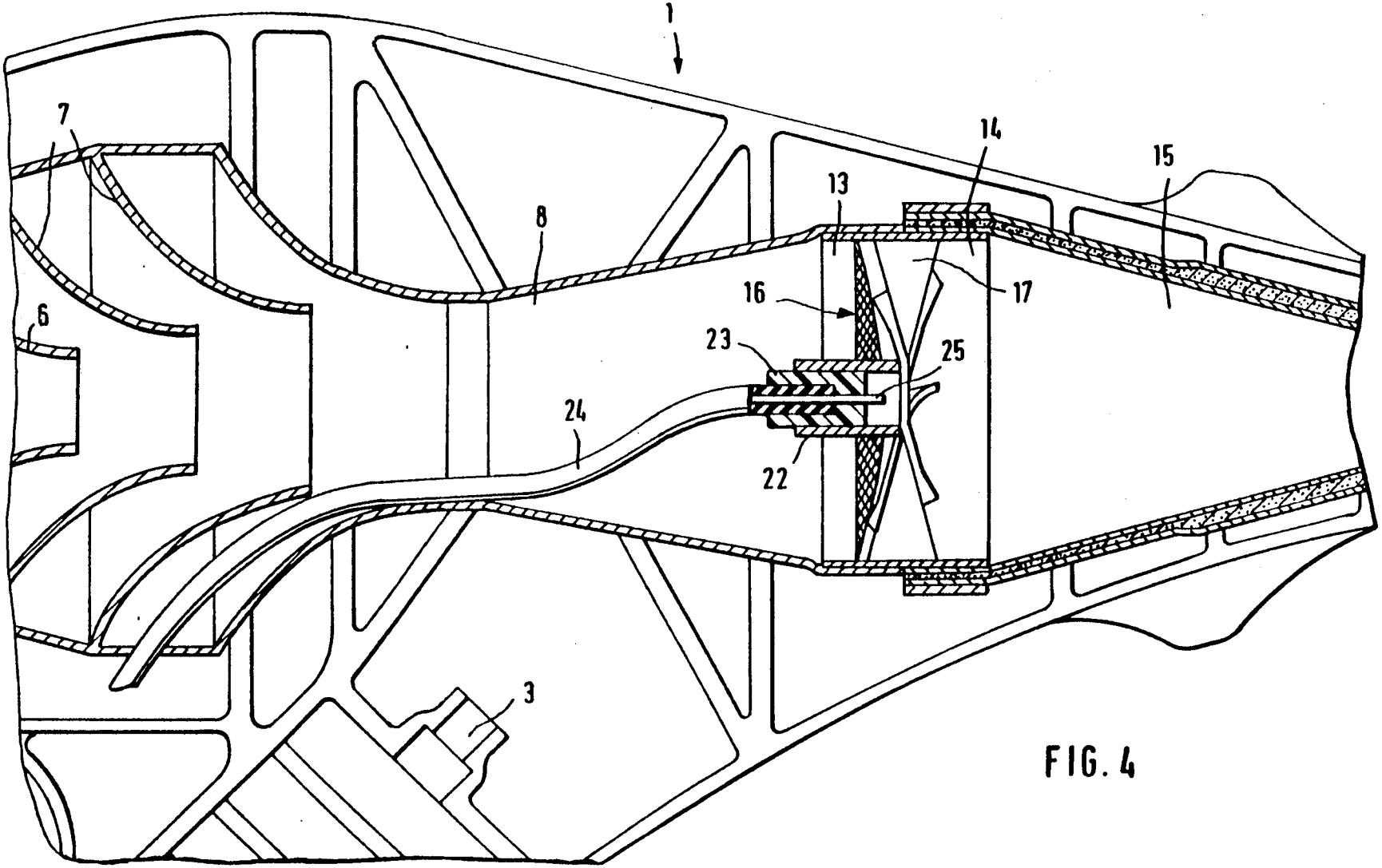
Figure 5:
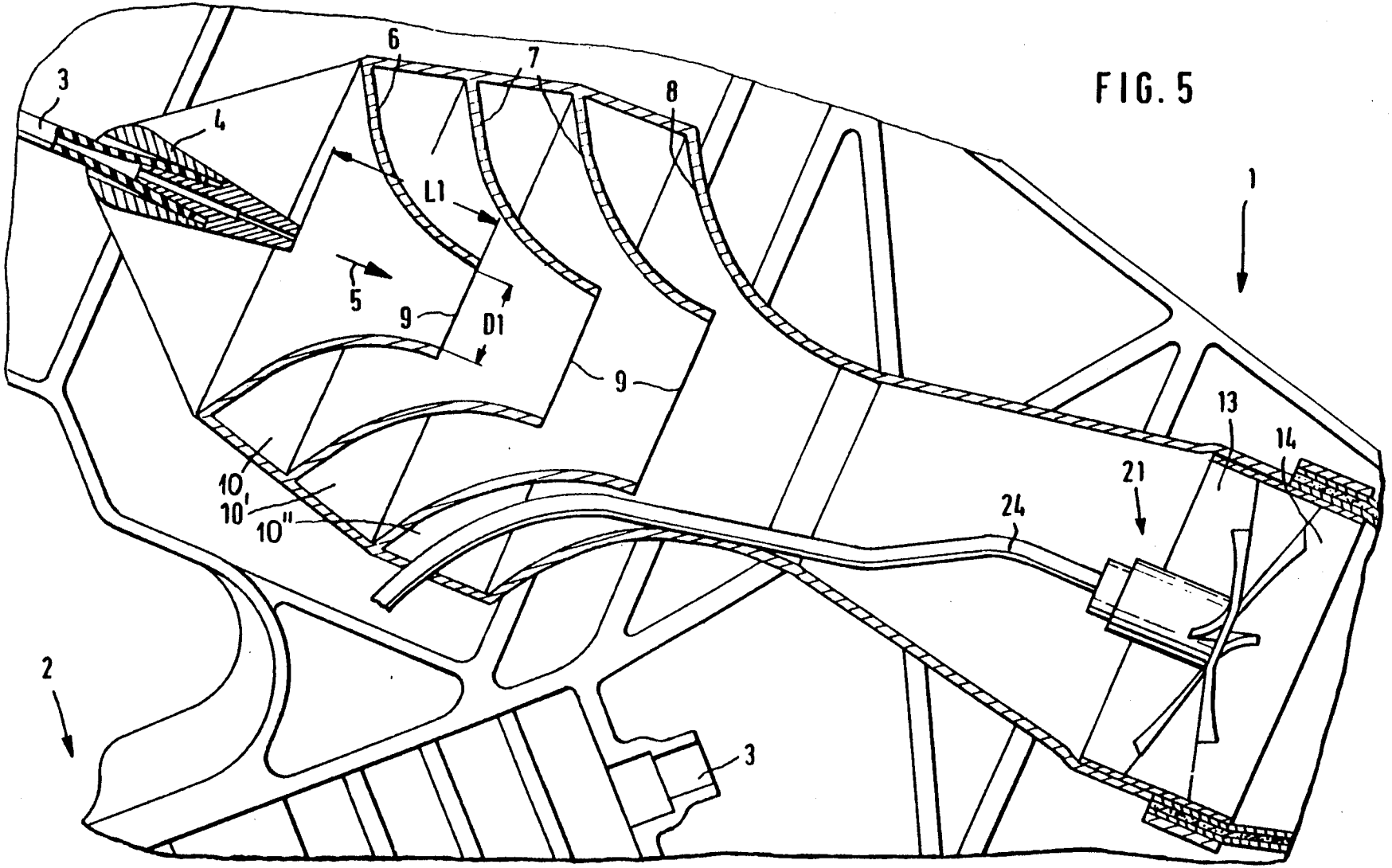

Furthermore as indicated in FIG. 2 the igniter 21 and flame suppressor 14 are spaced downstream by a distance L from the downstream end of the downstream end of the output nozzle 15, which here has at its downstream end a diameter T. Furthermore the combustion and mixing chambers 13 and 14 have a diameter D and the igniter 21 and suppressor 14 are spaced from the upstream end of the frustoconical nozzle 15 by a distance 1. The following relationship holds between these dimensions:

$$t/1 = L/D.$$

In addition the downstream end 9 of the upstream mixing tube 6 has a diameter $D_1$ and is spaced a distance $L_1$ from the downstream end of the teardrop-shaped injector nozzle 4 with the following relationship holding between these dimensions:

$$1.5 \times D_1 < L_1, 2.5 \times D_1$$

We claim:

1. A gas-fired heat gun comprising:

a housing;

means including a nozzle in the housing for directing a stream of a combustible gas in a predetermined direction along an axis in the housing;

at least two mixing tubes including an upstream tube and a downstream tube in the housing coaxial with the nozzle and downstream therefrom, each tube having a large-diameter upstream end and a small-diameter downstream end with the downstream end of the upstream tube spacedly received within the upstream end of the downstream tube, the housing being formed with ports supplying air to the upstream ends of the mixing tubes, whereby air is entrained axially into both upstream ends by the combustible-gas stream;

a combustion chamber in the housing coaxial with and immediately downstream of the downstream end of the downstream tube, the chamber being generally cylindrical and having a predetermined diameter D;

an output nozzle having an upstream end of the diameter D connected to the chamber and a downstream end of a diameter T smaller than the diameter D spaced axially downstream therefrom; and a flame arrester in the chamber spaced upstream by a predetermined distance 1 from the upstream end of the output nozzle and a predetermined distance L from the downstream end of the output nozzle, the distance end diameters substantially conforming to the relationship $$T/1 = L/D.$$

2. The gas-fired heat gun defined in claim 1 wherein the downstream end of the downstream tube is of greater diameter than the downstream end of the upstream tube.

3. The gas-fired heat gun defined in claim 2 wherein the downstream tube is a venturi.

4. The gas-fired heat gun defined in claim 1 wherein the housing is provided at least around the ports with sound insulation.

5. The gas-fired heat gun defined in claim 4 wherein the insulation is ceramic.

6. The gas-fired heat gun defined in claim 1, further comprising:

an electrical igniter in the chamber against the arrester.

* * * * *